US005865913A

United States Patent [19]

Paulin et al.

[11] Patent Number: 5,865,913

[45] Date of Patent: Feb. 2, 1999

[54] DEEP CRYOGENIC TEMPERING PROCESS BASED ON FLASHING LIQUID NITROGEN THROUGH A DISPERSAL SYSTEM

[75] Inventors: Peter J. Paulin; John R. Koucky; Robert W. Brunson, all of Decatur, Ill.

[73] Assignee: 300 Below, Inc., Decatur, Ill.

[21] Appl. No.: 960,941

[22] Filed: Oct. 30, 1997

Related U.S. Application Data

[63] Continuation of Ser. No. 423,379, Jun. 19, 1995, abandoned.

[51] Int. Cl.[6] ..... C21D 6/04

[52] U.S. Cl. ..... 148/577; 148/578; 148/909; 62/64; 62/65

[58] Field of Search ..... 148/577, 578, 148/909; 62/64, 65

[56] References Cited

U.S. PATENT DOCUMENTS

| | | | |
|---|---|---|---|
| 3,819,428 | 6/1974 | Moore | 148/125 |
| 3,891,477 | 6/1975 | Lance et al. | 148/125 |
| 4,482,005 | 11/1984 | Voorhees | 165/2 |
| 4,622,080 | 11/1986 | Wegwerth | 148/211 |
| 4,873,605 | 10/1989 | Drits et al. | 361/143 |
| 5,183,518 | 2/1993 | Radon | 148/324 |
| 5,259,200 | 11/1993 | Kamody | 62/64 |
| 5,263,886 | 11/1993 | Workman | 445/7 |

*Primary Examiner*—Sikyin Ip

*Attorney, Agent, or Firm*—Wilson Sonsini Goodrich & Rosati

[57] ABSTRACT

A method for treating firearm barrels and components to achieve an end result of increased accuracy and extended barrel life. The method involves placing the firearm barrels and components into cryogenic processing and heat treating equipment. The processing temperature is then significantly lowered to about −300 F. and maintained for a predetermined time. The processing temperature is then raised back to ambient temperature. After achieving ambient temperature the processing temperature is then raised to about +300 F. and maintained for a predetermined time. Finally the processing temperature is lowered back to ambient temperature.

20 Claims, 2 Drawing Sheets

FIG. −1

DEEP CRYOGENIC TEMPERING PROCESS BASED ON FLASHING LIQUID NITROGEN THROUGH A DISPERSAL SYSTEM

CROSS REFERENCES TO RELATED APPLICATIONS

This application is a continuation of U.S. Ser. No. 08/423,379, filed Jun. 19, 1995, now abandoned, the entire contents of which are hereby incorporated by reference.

BACKGROUND

1. Field of Invention

This invention relates to firearm barrels and components, specifically a method for improving accuracy and extending the useful life of the firearm.

2. Description of Prior Art

Many tempering processes for treating metals and other materials are known. Controlled thermal cycling treatments have been applied to various metals for a number of years.

One of the benefits of tempering is stress relief. There is always some stress in the metal as a result of heat treating, forming or manufacturing. Additional stress is imparted to the metal from machining and finishing operations.

The most common method for stress relief of firearm barrels is conventional heat treating. Typical stress relief heat treating is the uniform heating of a structure or a portion thereof to a suitable temperature below the transformation range and holding at this temperature for a predetermined period of time followed by uniform cooling.

Conventional heat treating however can cause distortion and damage to coatings and other surface treatments. Some residual stresses however appear to remain even after this stress relieving operation.

This invention relates a new method to promote stress relief by deep cryogenic tempering which does not cause any damage to the firearm barrel, coatings, surface treatments or components.

The most common items to receive some type of sub-ambient tempering treatment have been those in the tool and die industry. It has been found that sub-ambient treatment (freezing to −120 F.) improves the wear resistance and stress relief of these items. The improvement is greatly increased by deep cryogenic treatment. Deep cryogenic treatment is performed at −300 F.

Sub-ambient treatments in the past utilized a liquid process which in some cases will cause thermal shock. This is detrimental as it will add stress to the structure.

This invention will treat firearm barrels and components to greatly improve the stress relief and to increase wear resistance without the danger of thermal shock.

OBJECTS AND ADVANTAGES

It is therefore an object of this invention to provide a method of permanently relieving the residual stresses inherent in firearm barrels and components for the purpose of improving the overall accuracy of the firearm.

The process of this invention involves the use of a controlled profile (descent-static-ascent) process. The process involves lowering the temperature of the item to approximately −300 F., remaining at temperature for a predetermined time, raising the temperature to ambient, and then increasing the temperature to approximately +300 F., and finally returning to ambient temperature.

A process for treating firearm barrels or components comprises the steps of: (a) providing a quantity of firearm barrels or components at a temperature, said quantity of firearm barrels or components having a mass; (b) providing a cryogenic processor with a dispersal system; (c) loading said cryogenic processor with said quantity of firearm barrels or components; (d) flashing liquid nitrogen through said dispersal system so as to gradually lower the temperature of said quantity of firearm barrels or components to approximately −300° F.; (e) holding the temperature of said quantity of firearm barrels or components at approximately −300° F. for a first pre-determined time; (f) gradually raising the temperature of said quantity of firearm barrels or components to ambient temperature; (g) tempering said quantity of firearm barrels or components at approximately +300° F.; and (h) gradually lowering the temperature of said quantity of firearm barrels or components to ambient temperature.

Firearm barrels treated with this process exhibited reduced residual stress. As a result firearm barrels were more accurate, which resulted in tighter shot groups.

It is another object of this invention to provide improved wear resistance for the purpose of extending the useful life of firearm barrels.

Still further objects and advantages will become apparent from a consideration of the ensuing description and accompanying drawings.

PREFERRED EMBODIMENT—DESCRIPTION

Figure 1:
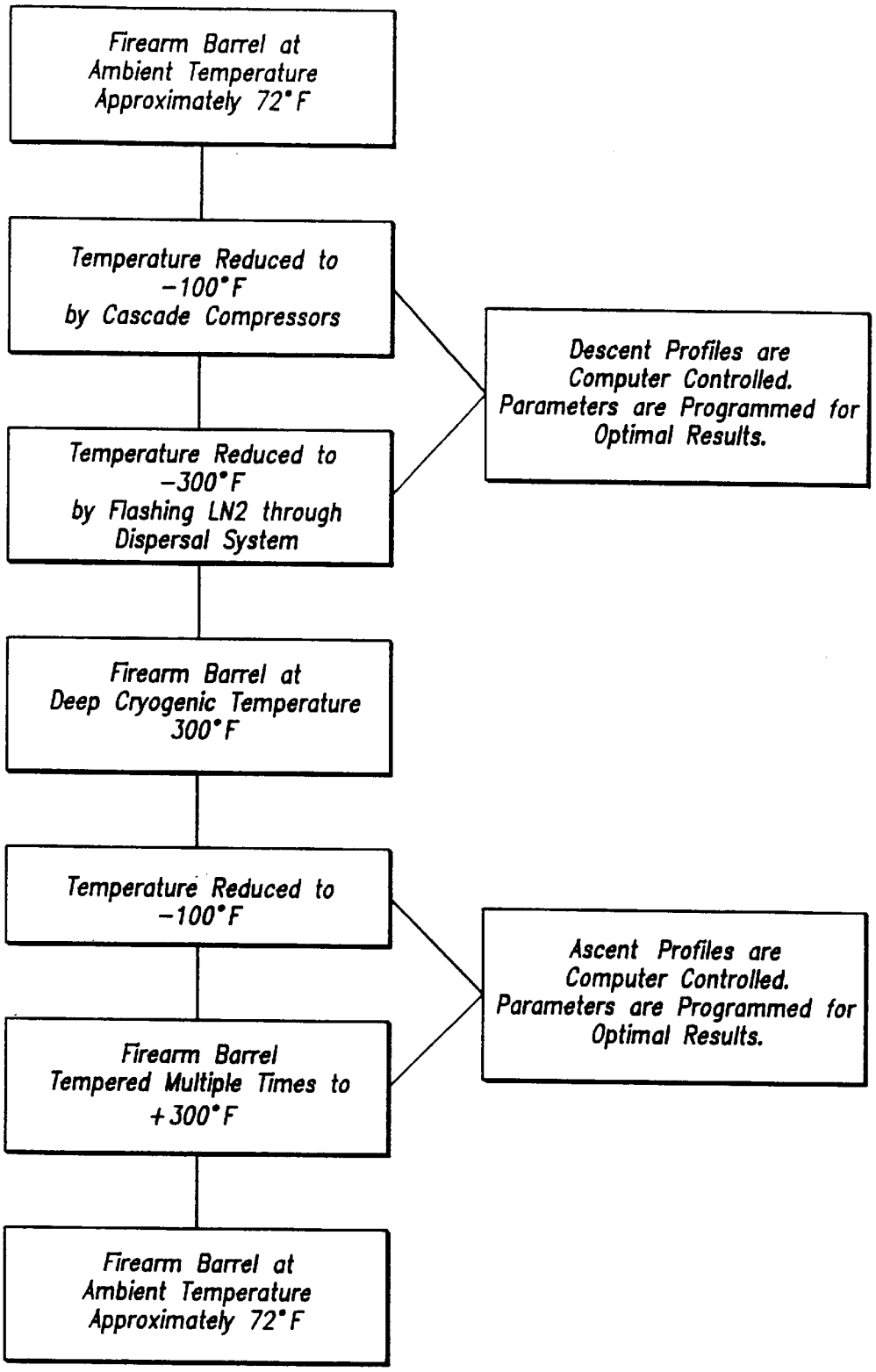
FIG. 1 is a block diagram depicting the process flow.

The preferred embodiments herein described are not intended to be exhaustive or to limit the invention to the precise forms disclosed. They are chosen and described to illustrate the principles of the invention and its application and practical use to enable other skilled in the art to follow its teaching.

The process of this invention involves the controlled thermal profile (descent-static-ascent) of firearm barrels and components. While the steps of the process, particularly as they are applied to firearm barrels and components, are unique, the cryogenic processing and heat treating equipment used in the tempering process is known to those skilled in the art and will not be described in detail in the interests of clarity.

Generally, the method involves cryogenically treating firearm barrels and components. Firearm barrels and components have wide range application in the shooting industry and their composition and function is well-known. Typical firearm barrels and components include a barrel, receiver, action, trigger assembly, and in some cases gas cylinder tubes, rods and valves.

The accuracy of a firearm is directly tied to the heat generated by repeated firing and the wear of the firearm barrel. As the firearm barrels heat up from repeated firing they will warp off axis due to residual stresses in the metal structure. This movement though ever so slight when measured at the muzzle becomes quite significant when measured at a target 200–300 yards away. In addition as the firearm barrels wear, their ability to maintain accuracy is severely diminished. Frequent replacement of conventional firearm barrels and components is necessary, particularly in benchrest shooting, varmint hunting, shooting teams, and the military.

Firearm barrels and components treated with the controlled thermal profiling process of this invention have demonstrated that they have reduced residual stresses and increased wear resistance. This allows the firearm barrels and components to be fired with greater accuracy for longer periods of time.

Preferred Embodiment—Operation

The tempering process generally involves the gradual lowering of the temperature of the firearm barrels and components, to cryogenic temperatures, of −300 F.(−185 C.) or lower. After the firearm barrels and components have attained the desired temperature, they are held at that level for a predetermined time. The firearm barrels and components are then gradually raised back to room temperature, about 72 F.(22 C.).

After the firearm barrels and components have reached room temperature, they are heat treated by gradually raising the temperature to +300 F.(149 C.), holding the firearm barrels and components at that temperature for a predetermined time, then gradually cooling the firearm barrels and components to ambient temperature.

The process described above is performed with deep cryogenic processing and heat treating equipment. The firearm barrels and components are placed in a treatment chamber which is connected to a mechanical pumping and/or supply of cryogenic fluid such as liquid nitrogen or another like fluid. Exposure of the chamber of the cryogenic cooling system lowers the temperature of the firearm barrels and components until the desired temperature is achieved. Control devices of a common nature are employed to ensure that the cooling is gradual which averts damage to the firearm barrels and components which may occur of subjected to rapid cooling. As stated above, this machinery is known to those skilled in the art, and does not add to the novelty of the process. Heating of the firearm barrels and components can also be accomplished in any manner.

FIG. 1 is a flow chart which illustrates the process of this invention in general terms. As seen in FIG. 1, the profiling of the cooling and heating steps include several variables.

The temperature profiling variables are programmed into a conventional microprocessor. This allows control of the cooling and heating processes while maintaining consistency and ensuring that the items receive full benefit of the treatment with limited risk of damage.

Figure 2:
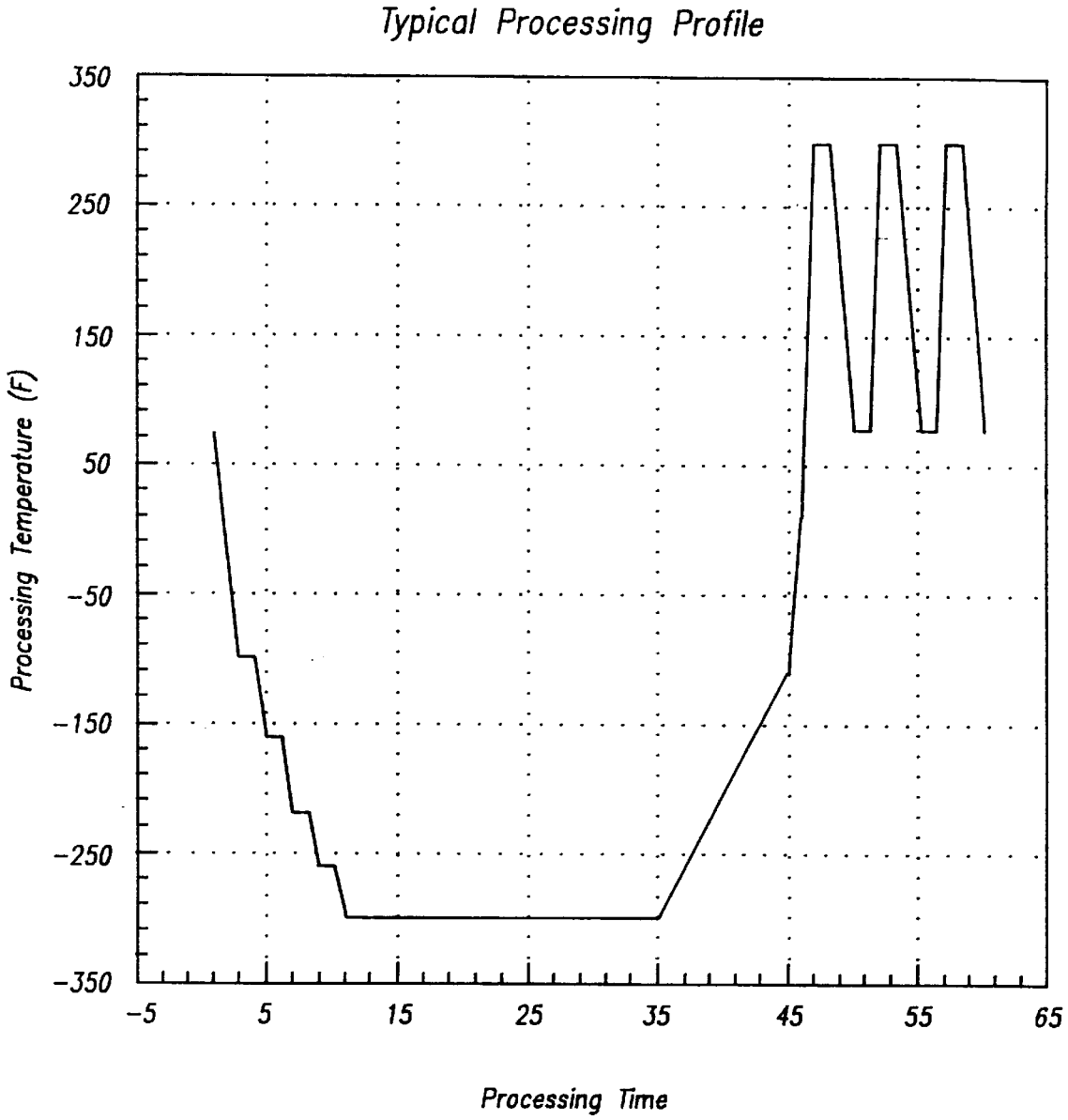
FIG. 2 shows the typical profile (descent-static-ascent).

As shown in FIG. 2, the detailed steps of the process involve placing room temperature (72 F.) firearm barrels and components in the cryogenic processor and gradually reducing the temperature in the chamber to about −300 F. As shown, this temperature change (known as the descent profile of the process) is preferably accomplished over a period of hours, depending upon the total mass of the processing load and the materials treated.

The firearm barrels and components are then kept in the cryogenic processor at a static temperature (about −300 F. or lower) for a predetermined period of time, dependent upon the total mass of the processing load and the materials treated. This is known as the static phase of the process.

When the static phase is complete, the temperature of the cryogenic chamber is gradually increased to ambient temperature, with the rate of ascent dependent upon the total mass of the processing load and the materials treated. This is known as the ascent profile of the process.

When the firearm barrels and components have reached ambient temperature, they are heated to about +300 F., the exact temperature to be determined by the material of the item being processed. Heating is generally accomplished much more rapidly than cooling with the firearm barrels and components attaining the predetermined temperature, dependent upon the configuration and materials treated.

After the firearm barrels and components are heated to about +300 F., they are kept in the chamber at that temperature for a period dependent upon the configuration and materials treated.

Finally, when the heating phase is completed, the firearm barrels and components in the chamber are gradually cooled to allow them to return once more to ambient temperature. This cool down phase is normally achieved in about one hour. When the treated firearm barrels and components achieve ambient temperature, they are removed from the treatment chamber and are ready for use.

Firearm barrels and components treated according to the process of this invention consistently show improvement in accuracy and increased wear resistance for longer barrel life.

Conclusions, Ramifications, And Scope

Accordingly, it can be seen that this invention provides a method for increasing the accuracy and useful life of firearm barrels which is simple, efficient and is clean to operate.

Although the description above contains many specificities, these should not be construed as limiting the scope of the invention but as merely providing illustrations of some of the presently preferred embodiments of this invention. Various other embodiments and ramifications are possible within its scope. For example, many different profiled tempering parameters can be utilized for the stress relief of rifle barrels, depending upon what type of material said rifle barrel is manufactured, size of said rife barrel and components, and configuration.

Thus the scope of the invention should be determined by the appended claims and their legal equivalents, rather than by the examples given.

It should be noted that the procedures and temperature ranges recited above in no way limit the scope of this invention to the precise details given. Instead, the scope of the invention is defined by the following claims.

What is claimed is:

1. A process for treating firearm barrels comprising the steps of:

(a) providing a quantity of firearm barrels at a temperature, said quantity of firearm barrels having a mass;

(b) providing a cryogenic processor with a dispersal system;

(c) loading said cryogenic processor with said quantity of firearm barrels;

(d) flashing liquid nitrogen through said dispersal system so as to gradually lower the temperature of said quantity of firearm barrels to approximately −300 degrees F.;

(e) holding the temperature of said quantity of firearm barrels at approximately −300 degrees F. for a first predetermined time;

(f) gradually raising the temperature of said quantity of firearm barrels or components to ambient temperature;

(g) tempering said quantity of firearm barrels at approximately +300 degrees F.; and (h) gradually lowering the temperature of said quantity of firearm barrels to ambient temperature.

2. The process of claim 1 wherein step (d) includes gradually lowering the temperature of said firearm barrels over a second predetermined time period, said second predetermined time period being dependent upon a total mass of a processing load, said total mass of said processing load including said mass of said quantity of firearm barrels.

3. The process of claim 2 wherein said first predetermined time period is dependent upon said total mass of said processing load.

4. The process of claim 3 wherein step (f) includes gradually raising the temperature of said quantity of firearm barrels over a third predetermined time period, said third predetermined time period being dependent upon said total mass of said processing load.

5. The process of claim 4, wherein step (g) includes raising the temperature of said quantity of said firearm barrels to an exact temperature to be determined by a material that composes said firearm barrels.

6. The process of claim 5 wherein step (h) includes gradually lowering the temperature of said quantity of firearm barrels over a one hour period.

7. The process of claim 1 further comprising repeating step (g) before step (h).

8. A process for treating firearm components comprising the steps of:

(a) providing a quantity of firearm components at a temperature, said quantity of firearm components having a mass;

(b) providing a cryogenic processor with a dispersal system;

(c) loading said cryogenic processor with said quantity of firearm components;

(d) flashing liquid nitrogen through said dispersal system so as to gradually lower the temperature of said quantity of firearm components to approximately −300 degrees F.;

(e) holding the temperature of said quantity of firearm barrels components at approximately −300 degrees F. for a first predetermined time;

(f) gradually raising the temperature of said quantity of firearm components to ambient temperature;

(g) tempering said quantity of firearm components at approximately +300 degrees F.; and (h) gradually lowering the temperature of said quantity of firearm components to ambient temperature.

9. The process of claim 8, wherein step (d) includes gradually lowering the temperature of said firearm components over a second predetermined time period, said second predetermined time period being dependent upon a total mass of a processing load, said total mass of said processing load including said mass of said quantity of firearm components.

10. The process of claim 9, wherein said first predetermined time period is dependent upon said total mass of said processing load.

11. The process of claim 10, wherein step (f) includes gradually raising the temperature of said quantity of firearm components over a third predetermined time period, said third predetermined time period being dependent upon said total mass of said processing load.

12. The process of claim 11, wherein step (g) includes raising the temperature of said quantity of said firearm components to an exact temperature to be determined by a material that composes said firearm components.

13. The process of claim 12, wherein step (h) includes gradually lowering the temperature of said quantity of firearm components over a one hour period.

14. The process of claim 8, further comprising repeating step (g) before step (h).

15. A method, comprising:

(a) providing a quantity of components at a temperature, said quantity of components having a mass;

(b) providing a cryogenic processor with a dispersal system;

(c) loading said cryogenic processor with said quantity of components;

(d) flashing liquid nitrogen through said dispersal system so as to gradually lower the temperature of said quantity of components to approximately −300 degrees F.;

(e) holding the temperature of said quantity of firearm barrels components at approximately −300 degrees F. for a first predetermined time;

(f) gradually raising the temperature of said quantity of components to ambient temperature;

(g) tempering said quantity of components at approximately +300 degrees F.; and (h) gradually lowering the temperature of said quantity of components to ambient temperature.

16. The method of claim 15, wherein step (d) includes gradually lowering the temperature of said components over a second predetermined time period, said second predetermined time period being dependent upon a total mass of a processing load, said total mass of said processing load including said mass of said quantity of components.

17. The method of claim 16, wherein said first predetermined time period is dependent upon said total mass of said processing load.

18. The method of claim 17, wherein step (f) includes gradually raising the temperature of said quantity of components over a third predetermined time period, said third predetermined time period being dependent upon said total mass of said processing load.

19. The method of claim 18, wherein step (g) includes raising the temperature of said quantity of said components to an exact temperature to be determined by a material that composes said components.

20. The method of claim 19, wherein step (h) includes gradually lowering the temperature of said quantity of components over a one hour period.

* * * * *

UNITED STATES PATENT AND TRADEMARK OFFICE

CERTIFICATE OF CORRECTION

PATENT NO. : 5,865,913
DATED : February 2, 1999
INVENTOR(S) : Paulin, et al.

It is certified that errors appears in the above-identified patent and that said Letters Patent is hereby corrected as shown below:

Column 2, line number 37, "other skilled in the art" should be --others skilled in the art--.

Column 3, on or around printer line number 32, "may occur of subjected" should be --may occur if subjected--.

In Figure 1,the fourth the box down on the left, "300°F"should be --300°F--.

Signed and Sealed this

Fifteenth Day of June, 1999

*Attest:*

Q. TODD DICKINSON

*Attesting Officer*

*Acting Commissioner of Patents and Trademarks*